United States Patent [19]

Bailey et al.

[11] Patent Number: 4,479,103

[45] Date of Patent: Oct. 23, 1984

[54] POLARIZED ELECTROMAGNETIC DEVICE

[75] Inventors: J. Milton Bailey, Knoxville; Igor Alexeff, Oak Ridge, both of Tenn.; Werner H. Kreidl, Vaduz, Liechtenstein

[73] Assignee: Motor Magnetics, New York, N.Y.

[21] Appl. No.: 137,229

[22] Filed: Apr. 4, 1980

[30] Foreign Application Priority Data

Apr. 5, 1979 [AT] Austria ..... 2551/79

[51] Int. Cl.[3] ..... H01F 7/00

[52] U.S. Cl. ..... 335/229; 335/230

[58] Field of Search ..... 335/229, 230, 234, 285, 335/284, 289, 290, 291, 295

[56] References Cited

U.S. PATENT DOCUMENTS

| | | | |
|---|---|---|---|
| 3,089,064 | 5/1963 | DeBennetot | 335/229 X |
| 3,146,381 | 8/1964 | Moreau | 335/289 X |
| 3,281,739 | 10/1966 | Grengg | 335/229 |
| 3,302,146 | 1/1967 | Zocholl | 335/230 |
| 3,544,935 | 12/1970 | Sterff | 335/230 X |
| 3,715,695 | 2/1973 | Hofman | 335/229 |
| 4,240,055 | 12/1980 | Shimizu et al. | 335/229 X |

*Primary Examiner*—George Harris

*Attorney, Agent, or Firm*—Fitzpatrick, Cella, Harper & Scinto

[57] ABSTRACT

In an electromagnetic device a magnet arrangement is provided having an electromagnet and a permanent magnet, with the pole faces of the permanent magnet abutting the core of the electromagnet on both sides of the end portions of the coil of the electromagnet and the end portions of the core of the electromagnet forming or supporting the pole pieces of the magnet arrangement. The poles of the permanent magnet are adjacent the like poles of the electromagnet when the electromagnet is energized, and the maximum value of the energizing current of the electromagnet is sufficient but not greater than necessary for reaching the first practical saturation value of flux density in the pole ends of the core of the magnet arrangement with the permanent magnet removed therefrom.

7 Claims, 8 Drawing Figures

POLARIZED ELECTROMAGNETIC DEVICE

TECHNICAL FIELD

Figure 1:
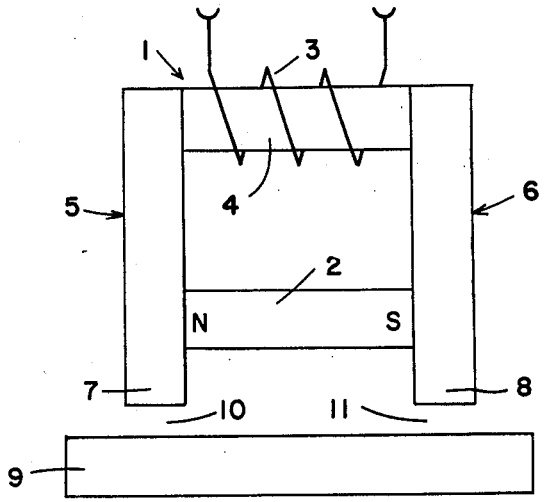

This invention relates to an electric device or machine having at least one magnet arrangement comprising an electromagnet and a permanent magnet, wherein the permanent magnet with its pole faces abuts the core of the electromagnet on both sides of the end portions of the coil of the electromagnet, the end portions of the core of the electromagnet form or support the pole pieces of the magnet arrangement, and the poles of the permanent magnet are adjacent the like poles of the electromagnet when the electromagnet is energized.

In such a magnet arrangement the magnetic flux path for the permanent magnet is shunted through the legs and the yoke of the electromagnet when the electromagnet is deenergized, so that the external magnetic flux originating from the pole pieces of the magnet arrangement is substantially zero. When the electromagnet is increasingly energized such that like poles originate at the end portions of the core of the electromagnet adjacent the poles of the permanent magnet, the magnetic flux is forced into the external path through the pole pieces, and in that manner the magnetic flux of the electromagnet is superimposed on the magnetic flux of the permanent magnet.

BACKGROUND ART

It has been the opinion of experts skilled in the art that the cross-section of the legs and pole pieces from the location of abutment of the permanent magnet on the core of the electromagnet to the pole faces of the pole pieces of the magnet arrangement must be so dimensioned that when the magnetic flux of the permanent magnet and the magnetic flux of the fully energized electromagnet are superimposed on each other in these sections of the magnetic flux path magnetic saturation of the material will not be exceeded. If one is to cling to this opinion electric energy may be saved when energizing the electromagnet by additionally using a permanent magnet, but the quantity of material required for obtaining a desired magnetic flux as well as the size and weight of an electric device or machine provided with such a magnet arrangement cannot be reduced.

It is the objective of the invention to avoid this drawback of the known magnet arrangement. Tests carried out by applicant have surprisingly shown that the combined magnetic fluxes of the permanent magnet and the electromagnet can also be utilized without drastically increasing the cross-sections of the legs and pole pieces of the magnet arrangement, and consequently the invention essentially resides in that the cross-section of the pole pieces is smaller than the sum of the cross-section required for conducting the magnetic flux of the fully energized electromagnet alone at saturation and the cross-section required for conducting the magnetic flux of the permanent magnet alone at saturation.

The effect obtained by the invention, which contradicts a long-standing preconceived idea of the experts in the field, has not yet been fully explained physically.

The invention magnet arrangement can be used in all electromagnetic devices and electric machines wherein a magnetic field with high values of flux density is required, particularly if the magnetic field is to be periodically variable between zero and a maximum value.

In rotating electric machines the invention can be utilized in the stator and in the rotor or only in one of the two parts.

The invention may further be applied in electromagnetic devices such as lifting magnets, relays and magnetic separators for retaining and separating ferromagnetic particles from fluids.

An economical embodiment of the invention device or machine is obtained when the cross-section of the pole pieces is approximately equal to the cross-section required for conducting the magnetic flux of the fully energized electromagnet alone or of the permanent magnet alone at saturation.

The most pertinent prior art related to the background of this invention is disclosed in U.S. Pat. Nos. 4,064,442 and 4,132,911.

DISCLOSURE OF THE INVENTION

In an advantageous embodiment of the inventive device or machine the cross-section of the yoke of the electromagnet carrying the coil is in magnetic respects adapted to the cross-section of the permanent magnet, so that the yoke of the de-energized electromagnet is approximately saturated by the magnetic flux of the permanent magnet. In that way the magnetic flux path of the permanent magnet which directly abuts the legs or pole pieces of the electromagnet is shunted through the legs and the yoke of the deenergized electromagnet, and no appreciable magnetic flux enters from the pole faces of the pole pieces of the magnet arrangement into the external magnetic flux path. For example, in rotating electric machines the external flux path will always comprise an air gap which increases the reluctance, which is also the case with most other electric devices and machines. Energization of the electromagnet causes a magnetic flux in the yoke in opposite direction to the magnetic flux caused by the permanent magnet, and on account of the superimposition of both fluxes a magnetic flux originates in the external magnetic path.

With a view to reliable operation and favorable use of material it is advantageous if the ratio of the cross-sections of the permanent magnet and of the yoke of the electromagnet is inversely proportional to the ratio of the operating flux density of the permanent magnet and the saturation flux density of the yoke of the electromagnet. In such an embodiment in the absence of any energization of the electromagnet there will not yet occur any appreciable magnetic flux in the external magnetic flux path, but upon slight energization of the electromagnet a considerable magnetic flux will already be present also in the external magnetic flux path.

The optimum effect of the magnet arrangement can be obtained if in, operation, the electromagnet is energized to supply a magnetic flux that is about equal to the magnetic flux of the permanent magnet. If in that manner the fully enerized electromagnet and the permanent magnet supply approximately equal shares to the total magnetic flux, the magnetic flux in the external flux path can be controlled at a value between almost zero and approximately the double value of the magnetic flux supplied by the permanent magnet.

In that case the cross-section of the pole pieces, related to like magnetic properties, may be, in accordance with the invention, about as large as the cross-section of the yoke of the electromagnet. This results in very economical utilization of material.

The magnetic energy is proportional to the square of the magnetic flux or flux density. For the purpose of illustration the following approximation formula, which in practice is used for calculating the lifting force of a lifting magnet, is pointed out:

$$F=3.9\times10^5\times A\times B^2$$

wherein A represents the area of the pole faces in $m^2$, B the magnetic flux density in Tesla (10,000 Gauss=1T) and F the lifting force in Newton (1 lb=4.448N). The magnetic flux density of a DC-operated lifting magnet need merely be altered between zero and a maximum possible value in one single magnetization direction, and for that purpose the invention can be profitably applied to save electric energy and material used for the parts of the magnet arrangement conducting the magnetic flux as well as for copper windings thereof. In theory, doubling of the magnetic flux and thus a quadruple lifting force can be obtained by the invention with the same energization current as for an electromagnet without any additional permanent magnet. In tests which have been performed, an increase of the magnetic flux by 60% was achieved with the invention magnet arrangement, with an equal energization current as compared to an appropriate arrangement without permanent magnet.

In filter means for separating particles of ferromagnetic material from fluids, a matrix of rods or wires of ferromagnetic material is employed, which rods or wires are strongly magnetized during a separating cycle in order to magnetically attract and retain particles, and which are de-magnetized in the subsequent rinsing cycle. An inventive magnet arrangement suitable for that purpose may consist of a soft-iron rod each and a rod-shaped permanent magnet arranged in parallel thereto, both of which are surrounded by a coil, wherein the poles of the permenanet magnet abut the soft-iron rod outside of the end portions of the coil. Another possibility is to apply the inventive embodiment to the external magnet system comprising a permanent magnet and an electromagnet surrounding the matrix of soft-iron wires.

The invention can also be profitably used in rotating electric machines. In that case it need be borne in mind that the inventive magnet arrangement can readily be used for magnetic flux paths of the machine which are to produce a constant or pulsating field, while magnetic flux paths which are to be operated in both magnetization directions can be operated by the inventive magnet arrangement only in half cycles, so that two inventive magnet arrangements will be required for full-cycle operation. But because it is theoretically possible to increase the magnetic energy by a factor of four by means of the invention, an improvement will still be obtained over conventional magnet arrangements even if it is necessary to double the number of magnet arrangements and thus to halve the factor four to a factor two. In relation to the expenditure in iron and copper it is, for instance, possible to double the torque of an electric motor as compared to a conventional motor by applying the invention, in which case the so-called core losses caused by changes in the magnetization will moreover be reduced because of the lower iron mass.

The invention is illustrated in detail in the drawings.

Figure 2:
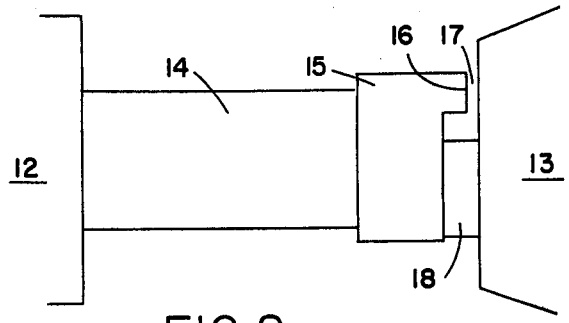
Figure 3:
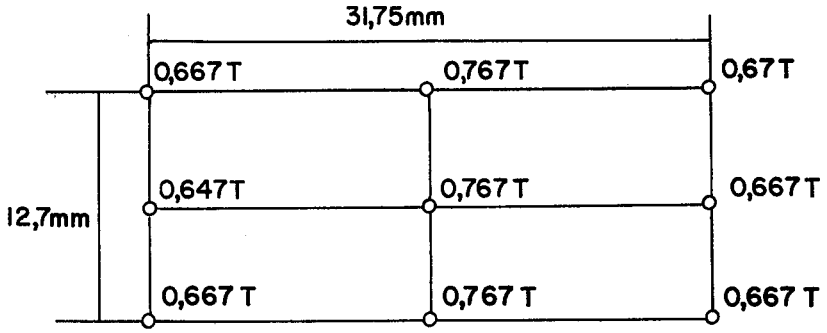
Figure 4:
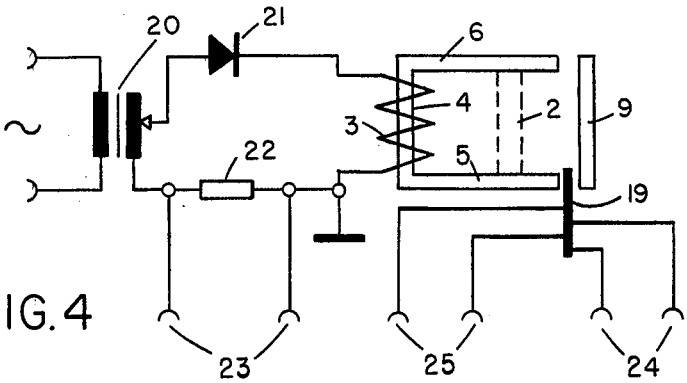
Figure 5:
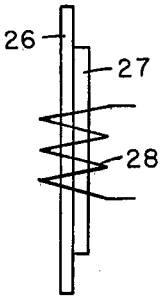
Figure 6:
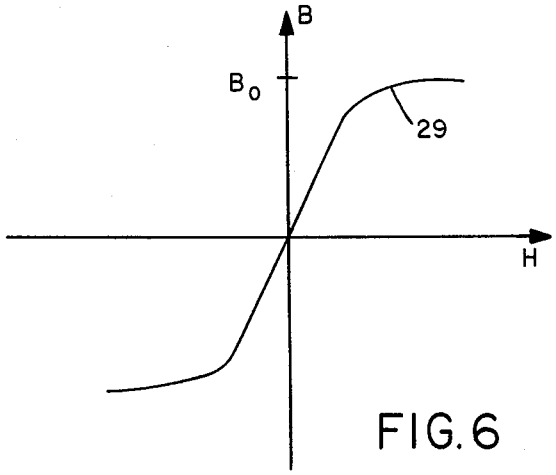
Figure 7:
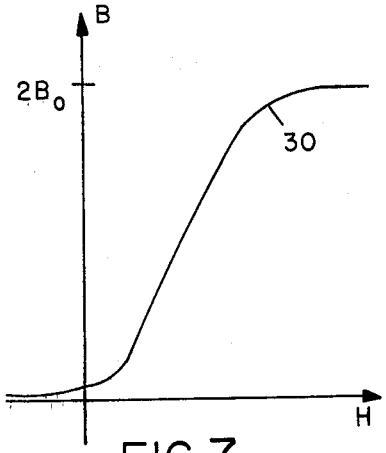
Figure 8:
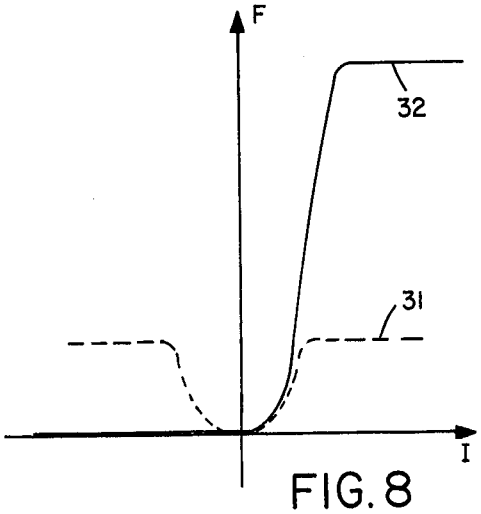

FIG. 1 shows a schematic representation of the inventive magnet arrangement for an electric device or machine, FIG. 2 an experimental arrangement for measuring the magnetic flux density in an air gap, FIG. 3 a diagram of the test data obtained by means of the arrangement according to FIG. 2, FIG. 4 an experimental arrangement for analyzing a magnet arrangement under energization by AC half waves, FIG. 5 a further magnet arrangement, and FIGS. 6, 7 and 8 illustrate the essential properties of the invention.

The magnet arrangement shown in FIG. 1 comprises an electromagnet 1 and a permanent magnet 2. The electromagnet has a yoke 4 of ferromagnetic material provided with a coil 3. Each of the two end faces of yoke 4 is firmly abutted by leg 5 and leg 6, respectively, of ferromagnetic material. The free end portions of legs 5 and 6 represent pole pieces 7 and 8, respectively. In FIG. 1 each pole piece is illustrated in one piece with the pertinent leg. Of course separate pole shoes of a ferromagnetic material deviating from the material of the legs and/or having a particular geometric shape could also butt-join the end portions of the legs. Permanent magnet 2 is inserted between legs 5 and 6 of the electromagnet, closely abutting the side faces of said electromagnet. Opposite the pole faces of pole pieces 7 and 8 of the magnet arrangement there is a keeper 9 of ferromagnetic material, an air gap 10 and 11, respectively, being present between pole faces and the keeper on both sides. Such an air gap is absolutely necessary in rotating electric machines having parts movable relative to each other, but very often an operating gap filled with non-ferromagnetic or non-paramagnetic material is also provided in other electromagnetic devices in order to prevent, for instance, adherence ("sticking") of the keeper to the electromagnet due to a residual magnetic flux or stray flux.

The cross-section of yoke 4, with respect to the magnetic properties of its material, is adapted to the operating flux density of the permanent magnet 2, so that the yoke of the de-energized electromagnet 1 is approximately saturated by the magnetic flux of permanent magnet 2. The entire magnetic flux of permanent magnet 2 therefore can pass through legs 5, 6 and yoke 4. Also, in the external magnetic flux path, which due to the presence of air gaps 10 and 11 exhibits increased reluctance and which comprises the keeper 9, no appreciable magnetic flux will occur merely because of the magnetism of permanent magnet 2. If, however, the electromagnet 1 is energized by passing a current through its coil 3 in such a way that in the illustration of FIG. 1 there will originate on the left-hand end portion of yoke 4 a north pole and on the right-hand end of yoke 4 a south pole, as is the case with permanent magnet 2, the magnetic flux in yoke 4 and in the portions of legs 5 and 6, facing away from pole pieces 7 and 8, respectively, caused by permanent magnet 2, will be more or less suppressed in dependence on the field strength of electromagnet 1 and in that way forced into the external magnetic flux path containing keeper 9. Considering the dimensions of the cross-section of the yoke as indicated above, electromagnet 1 and permanent magnet 2 will supply approximately equal shares of the magnetic flux in the external magnetic flux path when electromagnet 1 is energized in the strongest suitable manner.

Experts have always been of the opinion that in order to allow for additive superimposition of the magnetic fluxes of electromagnet 1 and permanent magnet 2 the cross-section of pole pieces 7 and 8 would have to be dimensioned such that saturation of the pole piece material would not be reached under the conditions mentioned above. However, it has now been discovered that such over-dimensioning of the pole piece cross-section is not required. When employing the magnet arrangement shown schematically in FIG. 1 as a lifting magnet, a particular lifting force could be exerted on keeper 9 when using electromagnet 1 alone (without the inserted permanent magnet 2) or when using the equally strong permanent magnet 2 alone (without inserted yoke 4). When using both magnets combined, in theory the four-fold lifting force could be achieved due to the doubling of the magnetic flux, and analogue considerations apply to the obtainable torque of a rotating electric mahine, in which case according to the findings of applicant the cross-section of pole pieces 7, 8, referred to like magnetic properties, need not be dimensioned larger than the cross-section of yoke 4 of electromagnet 1. This surprising and not yet fully explained circumstance possibly is caused by differing "generator properties" of an electromagnet on the one hand and a permanent magnet on the other as generators of magnetic fields. When compared to the generation of a magnetic field variable in its strength of one single magnetization direction by means of an electromagnet alone, not only energy but also material is saved by the inventive arrangement.

FIG. 2 is an experimental arrangement for determining the distribution of the magnetic flux density in the air gap of an inventive magnet arrangement. Reference numerals 12 and 13 indicate the poles of a large electromagnet not shown any further. The portion of the distance between the pole faces of the electromagnet not required for the experiment were bridged by a bundle 14 of a transformer laminations of liberally apportioned total cross-section. A pole piece 15 was attached to said bundle 14, and region 16 of the right-hand front face of said pole piece 15, which region protrudes toward pole 13 of the electromagnet, and defines an air gap 17 having a cross-section of $12.7 \times 37.75$ mm$^2$. In the lower larger region there was inserted a permanent magnet 18 having a square cross-section of a side length of 25.4 mm as well as a length of 6.35 mm, which permanent magnet 18 firmly abuts with one pole face pole 13 of the electromagnet and with the other pole face pole piece 15. The distribution of the magnetic flux density in air gap 17 was measured with a small Hall probe which at a particular energization of the electromagnet showed the uniform distribution of the flux density illustrated in the diagram of FIG. 3.

FIG. 4 illustrates a measuring arrangement for investigating an inventive magnet arrangement by means of technical alternating current at half-wave operation. A magnet arrangement according to FIG. 1 was studied, the mean magnetic path length being 55 mm in the yoke 4 (inclusive of the portion of the width of leg 5, 6) and 65 mm each in legs 5, 6. The cross-section of the yoke, the legs and the keeper 9 was 17.5 mm$\times$6.3 mm. Each air gap 10, 11 had a length of 0.25 mm and in one of said air gaps a Hall probe for measuring the magnetic flux density was disposed. The coil consisted of 1000 turns of wire.

An isolating variable transformer 20 was provided for optionally reducing the supply voltage. Since it is suitable to magnetize the electromagnet in only one direction, a diode 21 is disposed between the tap of transformer 20 and one end of coil 3. The other end of coil 3 is grounded. One end of the secondary winding of transformer 20 is grounded via a resistor 22 allowing current measurement. For measuring the energizing current of the electromagnet the voltage drop at resistor 22 is taken at terminal 23. A constant current of 50 mA is fed to the Hall probe 19 via terminals 24. In that case a voltage of 30 mV results at terminals 25 for a flux density in the air gap of 0.6T. Measuring instruments showing the peak value can be connected to terminals 23 and 25, but the processes can better be seen in full if terminals 23 and 25 are connected to the vertical inputs of a dual-channel oscilloscope whose horizontal deflection is synchronized with the supply frequency.

Coil 3 was first energized with a half-wave current of 0.7 A peak value without permanent magnet 2 present in the magnet arrangement, and no saturation of the soft-iron parts 4, 5, 6 and 9 occured up to that point. The peak value of the voltage transmitted by the Hall probe 19 at terminals 25 amounted to 23 mV, corresponding to a flux density of 0.46T.

Then permanent magnet 2 was inserted between legs 5 and 6 and the energizing current of the electromagnet was adjusted such that the Hall probe 19 again supplied a voltage having a peak value of 23 mV, corresponding to a magnetic flux density of 0.46T, at terminals 25. The peak value of the required magnetization current was only 0.4 A, which means a reduction of 43%. A comparison of the peak-to-peak value of the AC voltage at coil 3 in both instances showed a merely slight decrease from 65 V to 62 V.

Then the magnetization current was increased until saturation was attained. Without the inserted permanent magnet 2 a peak value of the current of 1.4 A was measured. The Hall probe 19 supplied a voltage of a peak value of 32 mV at terminals 25, corresponding to a flux density of 0.64T.

Then permanent magnet 2 was inserted in the magnet arrangement and the new measurement data were determined without any change in the adjustment of the variable transformer. The peak-to-peak-value of the AC voltage at coil 3 was 85 V in both cases. The peak value of the magnetizing current dropped to 0.7 A, that is by 50%, while the peak value of the voltage supplied by Hall probe 19 at terminals 25 rose to 42 mV, which signifies that the magnetic flux density, whose saturation previously commenced at 0.64T, now increased to 0.84T, that is by about 30%.

In the latter case the interaction of permanent magnet and electromagnet signified an increase of the magnetic flux density, which it would not have been possible to attain by merely increasing within reasonable bounds the magnetizing current of the magnet alone when no permanent magnet is present.

Among the numerous possible applications of the inventive magnet arrangement are all those instances where the magnetic flux or the magnetic flux density of a magnet system must be switchable or adjustable between about zero and a maximum value, as in the case of lifting magnets, relays, rotating electric machines and the like, and also magnetic filter devices for separating particles of ferromagnetic material from a fluid. In such devices there is provided in the flow path of the fluid a matrix made of wires consisting of ferromagnetic material, and these wires can be magnetized by means of an external electromagnet. During the separating phase the wires are magnetized as strongly as possible, and thus attract and retain ferromagnetic particles from the fluid. At the end of the separating phase the matrix is loaded with separated particles, and must be relieved of the depositions in a subsequent rinsing phase, in the course of which the magnetization is switched off and the wire matrix rinsed by a rinsing liquid, by means of which the particles previously retained are removed. In such a filtering device the external electromagnet advantageously can be replaced by an inventive magnet arrangement, as shown e.g. in FIG. 1.

For such and other purposes also an arrangement as shown in FIG. 5 is conceivable, wherein adjacent to a rod or wire 26 of soft-magnetic material there is arranged a permanent magnet 27 whose poles abut rod or wire 26 external the ends of a coil 28. Coil 28 in that case surrounds both the core of the electromagnet formed by rod or wire 26, and permanent magnet 27. In that case it is of essential importance that the rod or wire 26 projects from the permanent magnet 27 at both ends in longitudinal direction.

An interpretation of the mode of operation of the inventive arrangement can be provided by way of FIGS. 6, 7 and 8. FIG. 6 shows the magnetization curve of the soft-magnetic material of a magnetic flux path, which, for example, may be formed by parts 4, 5, 6 and 9 according to FIG. 1, and which represents an electromagnet when current is passed through coil 3. There is no preferred magnetization direction, the direction of magnetic field lines in the magnetic flux path may be either clockwise or counter-clockwise, depending on the electric energization, and the magnetizing curve in relation to the origin of the coordinate system is entirely symmetrical.

FIG. 7 indicates the change which is caused in the magnetic flux path by insertion of a permanent magnet 2 in the magnet arrangement illustrated in FIG. 1. One may understand this as a parallel displacement of the magnetization curve by the amount of the permanent field, which results in performance characteristic 30. If one succeeds to raise the upper limit of the magnetic flux density from $B_o$ in the diagram of FIG. 6 to a value of 2 $B_o$ in the diagram of FIG. 7, quadruplication of the reaction force can be achieved by the new magnet arrangement including an inserted permanent magnet as compared to an equally large and equally energized electromagnet.

This has been illustrated in FIG. 8, wherein the reaction force F has been entered in dependence on energization current I of the electromagnet. Dash-lined curve 31 shows the curve of the reaction force of an electromagnet symmetrical to the ordinate axis, the reaction force being independent of the direction of the current and only dependent on the intensity of the current at low intensities the well-known square dependency of the reaction force on the energization current is present, while at very high current intensities any further increase in the reaction force is no longer obtainable due to the magnetic saturation of the ferromagnetic material. Curve 32 shows the curve for an inventive magnet arrangement, which curve is also dependent on the direction of the magnetizing current. If the magnetic fluxes of the electromagnet and permanent magnet are additively combined in the external magnetic flux path, the contribution of electromagnet and permanent magnet being equal in accordance with FIG. 7, doubling of the magnetic flux as compared to energization by electromagnet alone and thus quadruplication of the reaction force can be achieved.

We claim:

1. An electric device or machine having at least one magnet arrangement comprising an electromagnet and a permanent magnet, wherein the permanent magnet with its pole faces abuts the core of the electromagnet on both sides of the end portions of the coil of the electromagnet, and the end portions of the core of the electromagnet form or support the pole pieces of the magnet arrangement, and wherein the poles of the permanent magnet are adjacent the like poles of the electromagnet to provide additive flux at a pair of pole ends of said core when the electromagnet is fully energized, characterized in that the core structure is so dimensioned that the maximum value of the energizing current of the electromagnet is sufficient but not greater than necessary for reaching the first practical saturation value of flux density in said pole ends of the core in the absence of said permanent magnet.

2. A device according to claim 1, characterized in that the cross-section of the pole pieces is approximately equal to the cross-section required for conducting the magnetic flux of the fully energized electromagnet alone or of the permanet magnet alone at saturation.

3. A device according to claim 1 or 2, characterized in that the cross-section of the yoke of the electromagnet carrying the coil is in magnetic respects adapted to the cross-section of the permanent magnet, so that the yoke of the de-energized electromagnet is approximately saturated by the magnetic flux of the permanent magnet.

4. A device according to claim 3, characterized in that the ratio of the cross-sections of the permanent magnet and of the yoke of the electromagnet is inversely proportional to the ratio of the operating flux density of the permanent magnet and the saturation flux density of the yoke of the electromagnet.

5. A device according to any one of claims 1 to 3, characterized in that when in operation the electromagnet is energized to supply a magnetic flux which is about equal to the magnetic flux of the permanent magnet.

6. A device according to claim 5, characterized in that related to like magnetic properties the cross-section of the pole pieces is about as large as the cross-section of the yoke of the electromagnet.

7. A device according to claim 1, characterized in that the cross-sectional area of the pole pieces or end portions of the core of the electromagnet, has a size such that at full energization of the electromagnet the double amount of the flux density corresponding to the first practical saturation value occurs.

* * * * *